US008616386B1

(12) United States Patent
Tsai

(10) Patent No.: US 8,616,386 B1
(45) Date of Patent: Dec. 31, 2013

(54) DRAWER STRUCTURE

(75) Inventor: Tsung-Yu Tsai, Changhua County (TW)

(73) Assignee: Dongguan Master United Plastic & Hardware Productrs Co., Ltd., Dongguan, Guandong Province (CN)

( * ) Notice: Subject to any disclaimer, the term of this patent is extended or adjusted under 35 U.S.C. 154(b) by 0 days.

(21) Appl. No.: 13/611,565

(22) Filed: Sep. 12, 2012

(51) Int. Cl.
*A47F 3/14* (2006.01)
*A47B 88/04* (2006.01)

(52) U.S. Cl.
USPC ..... 211/126.15; 312/334.44

(58) Field of Classification Search
USPC ..... 211/46, 71.01, 90.01, 90.02, 90.03, 211/126.1, 126.14, 126.15, 126.2, 126.9, 211/133.2, 133.5, 150, 151, 162, 170, 175, 211/181.1, 183, 187, 190; 108/137; 312/126, 128, 132, 330.1, 334.27, 312/334.44; 126/337 R, 339; D34/21
See application file for complete search history.

(56) References Cited

U.S. PATENT DOCUMENTS

| | | | | | |
|---|---|---|---|---|---|
| 1,872,733 | A * | 8/1932 | Greenwald | 126/337 R |
| 1,896,307 | A * | 2/1933 | Hatch | 312/408 |
| 1,946,532 | A * | 2/1934 | Hatch | 108/143 |
| 1,953,688 | A * | 4/1934 | Otte | 108/137 |
| 1,974,983 | A * | 9/1934 | Cook | 108/137 |
| 1,989,275 | A * | 1/1935 | Hatch | 312/408 |
| 1,995,399 | A * | 3/1935 | Reedy et al. | 126/339 |
| 2,008,091 | A * | 7/1935 | Betts | 108/137 |
| 2,033,860 | A * | 3/1936 | Otte | 312/408 |
| 2,033,861 | A * | 3/1936 | Otte | 312/408 |
| 2,078,681 | A * | 4/1937 | Otte | 312/246 |
| 2,466,360 | A * | 4/1949 | Bitney | 108/137 |
| 2,671,004 | A * | 3/1954 | Chadwick et al. | 312/350 |
| 4,725,066 | A * | 2/1988 | Nootenboom et al. | 280/79.3 |
| 6,148,813 | A * | 11/2000 | Barnes et al. | 126/339 |
| 6,732,662 | B2 * | 5/2004 | Welch et al. | 108/109 |
| 7,703,453 | B2 * | 4/2010 | Hughes | 126/339 |
| 7,954,424 | B2 * | 6/2011 | Dunn et al. | 99/426 |

FOREIGN PATENT DOCUMENTS

| | | |
|---|---|---|
| TW | M330071 | 4/2008 |

* cited by examiner

*Primary Examiner* — Joshua Rodden
(74) *Attorney, Agent, or Firm* — Muncy, Geissler, Olds & Lowe, PLLC

(57) ABSTRACT

Provided is a drawer structure including a carrying device and a holding device. The carrying device has a support and two position-limiting rods. The two position-limiting rods are disposed on two opposing sides of the support. The holding device is disposed above the carrying device, slides relative to the carrying device, and has a frame and a first stopping rod. The frame is disposed on the support and between the two position-limiting rods. The two position-limiting rods are positioned above the bottom of the frame. Front and rear ends of the first stopping rod are fixed to the frame and disposed at the frame. The first stopping rod has a long straight section, concave section, and short straight section. Front and rear ends of the concave section are connected to the long straight section and the short straight section, respectively. The bottom of the concave section penetrates the support.

4 Claims, 4 Drawing Sheets

DRAWER STRUCTURE

BACKGROUND OF THE INVENTION

1. Field of the Invention

The present invention relates to iron wire furniture, and more particularly, to a drawer structure.

2. Description of Related Art

There are two types of drawer structures, namely railed drawer structures and rail-less drawer structures. The present invention related to rail-less drawer structures rather than railed drawer structures, and thus functions and purposes of railed drawer structures are not described herein for the sake of brevity. Rail-less drawer structures are disclosed in the prior art, such as Taiwan utility model patent M330071, which discloses a holder drawer structure comprising a holder and a drawer. Two supporting frames are disposed at the bottom of the holder. The bottom of the holder carries the drawer. A hook rod-shaped position-limiting guiding portion is disposed at the top of the holder and engaged with the drawer when the drawer is pulled outward excessively, so as to prevent the drawer from sliding out of the holder drawer structure. The two supporting frames are equipped with two auxiliary lateral rods which are disposed on two sides of the drawer, respectively. However, the position-limiting functionality of the two auxiliary lateral rods is restricted to the two sides of the drawer. As a result, once the drawer is pulled outward, the front end of the drawer will automatically tilt downward.

SUMMARY OF THE INVENTION

The present invention provides a drawer structure comprising a carrying device and a holding device. The carrying device has a support and two position-limiting rods. The two position-limiting rods are disposed on two opposing sides of the support, respectively. The holding device is disposed on the carrying device, slides related to the carrying device, and has a frame and a first stopping rod. The frame is disposed on the support and disposed between the two position-limiting rods. The two position-limiting rods are disposed above the bottom of the frame. The front and rear ends of the first stopping rod are fixed to the front and rear sides of the frame, respectively, and disposed at the bottom of the frame. The first stopping rod has a long straight section, a concave section, and a short straight section. The front and rear ends of the top of the concave section are connected to the long straight section and the short straight section. The bottom of the concave section penetrates the support.

Due to its aforesaid structures, a drawer structure of the present invention enables a holding device to be firmly coupled to a carrying device and thereby prevents the holding device from being disconnected from the carrying device easily. Unlike the prior art, the present invention is characterized in that, in the course of the outward pull of the holding device, two position-limiting rods prevent the front end of the holding device from tilting downward.

In particular, the support further has two guiding rods which are spaced apart from each other and arranged in parallel. The front and rear ends of the two guiding rods are fixed to the front and rear supporting rods, respectively. The first stopping rod of the holding device is disposed between the two guiding rods and positioned proximate to one of the two guiding rods. Hence, the two guiding rods provide support to the two sides of the holding device and thereby prevent the holding device from vibration. The first stopping rod moves along one of the guiding rods and thereby limits the movement of the holding device in a single direction (to and fro).

BRIEF DESCRIPTION OF THE DRAWINGS

Technical features of the present invention are hereunder illustrated with a preferred embodiment in conjunction with the accompanying drawings, in which.

DETAILED DESCRIPTION OF THE EMBODIMENT OF THE INVENTION

Figure 1:
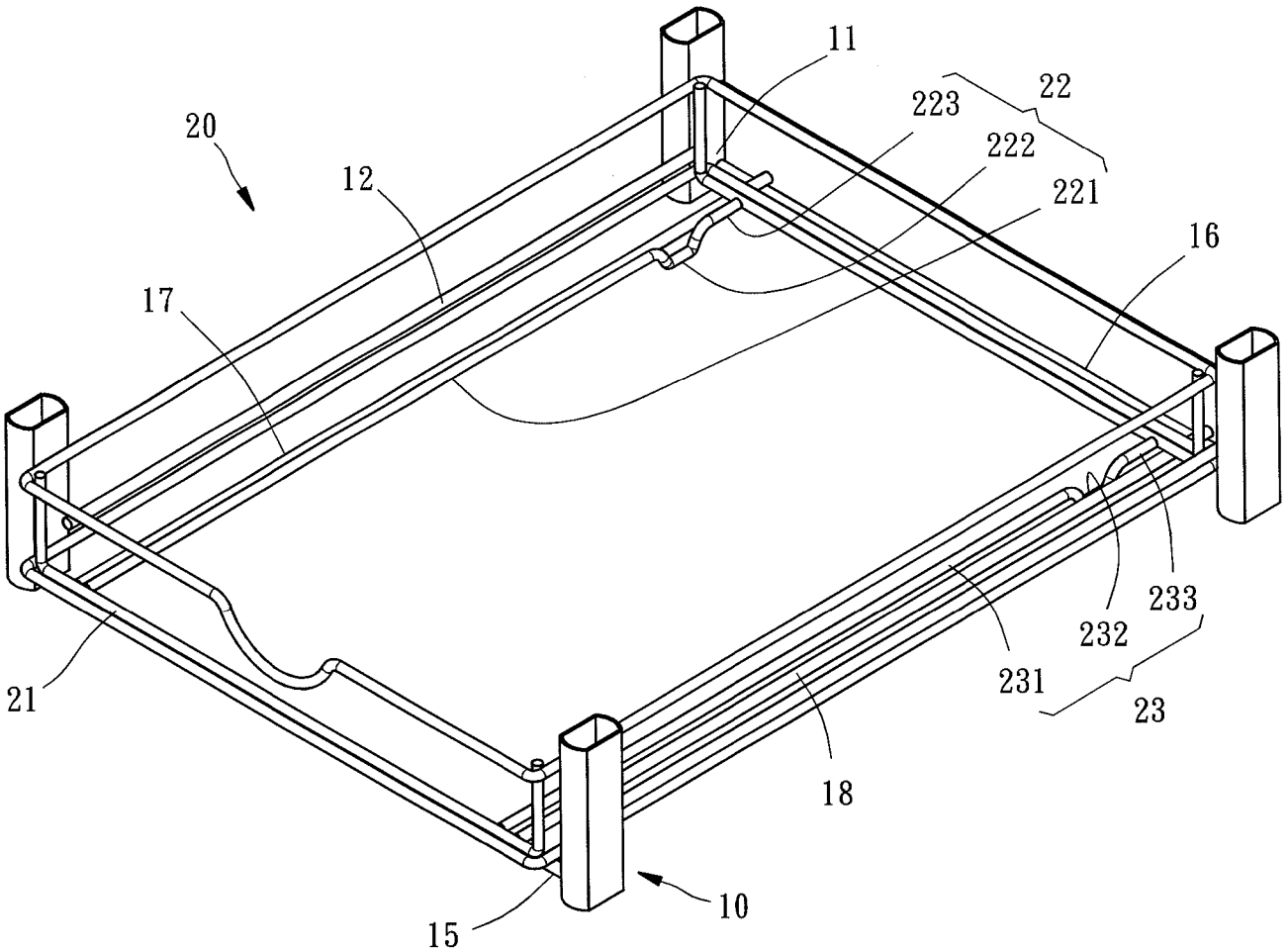
FIGS. 1, 2 are schematic views of a drawer structure according to a preferred embodiment of the present invention.
Figure 2:
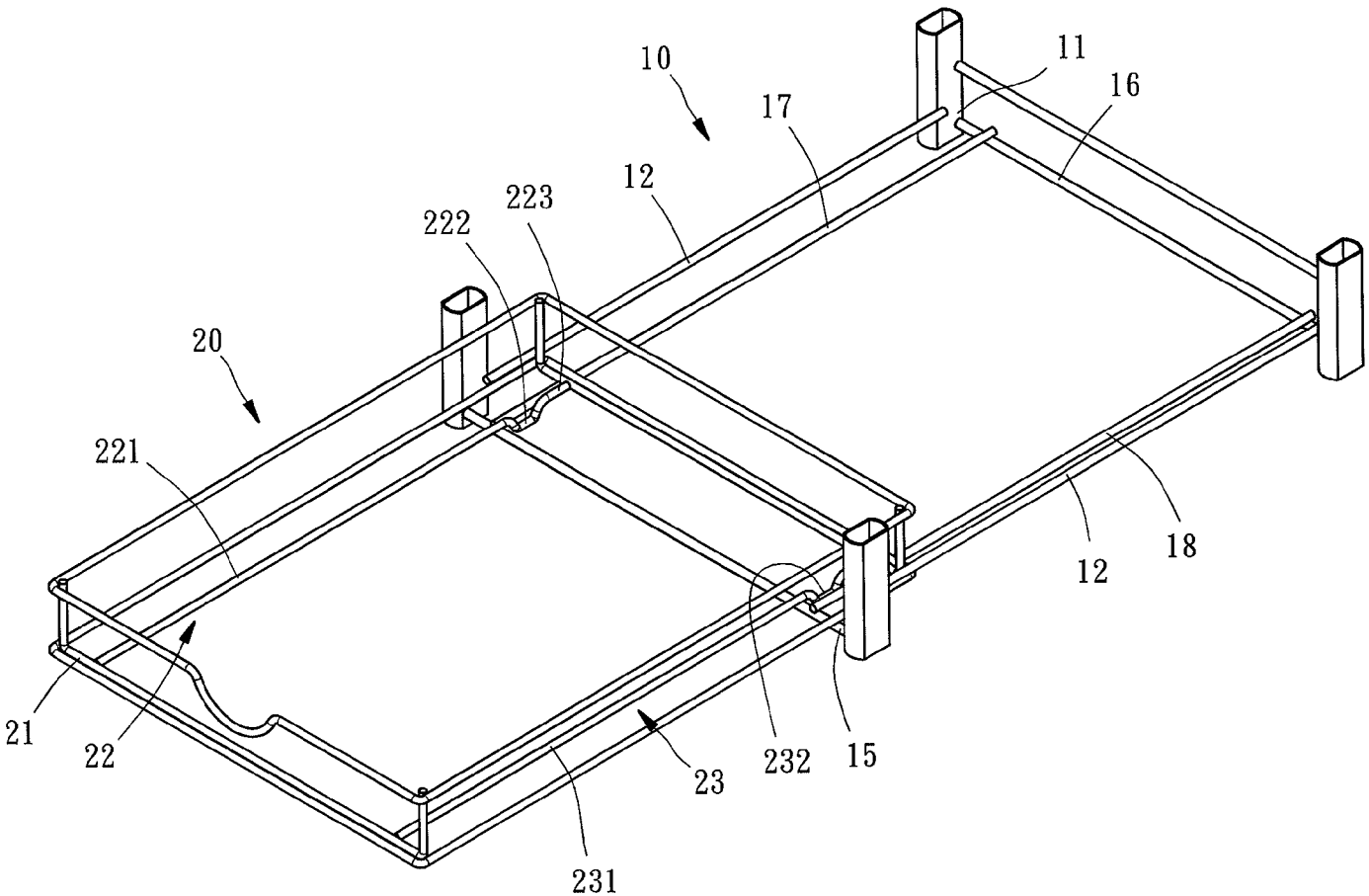

Referring to FIGS. 1, 2, there are shown schematic views of a drawer structure according to a preferred embodiment of the present invention. The drawer structure of the present invention comprises a carrying device 10 and a holding device 20. Preferably, the carrying device 10 and the holding device 20 are made from stainless steel rods, iron rods, or electroplated iron wires.

The carrying device 10 has a support 11 and two position-limiting rods 12. The two position-limiting rods 12 are disposed on two opposing sides of the support 11, respectively. The holding device 20 is disposed on the carrying device 10, slides relative to the carrying device 10, and has a frame 21, a first stopping rod 22, and a second stopping rod 23. The frame 21 is disposed on the support 11 and between the two position-limiting rods 12. The two position-limiting rods 12 are disposed above the bottom of the frame 21. The front and rear ends of the first and second stopping rods 22, 23 are fixed to the front and rear sides of the frame 21, respectively, and disposed at the bottom of the frame 21. The first and second stopping rods 22, 23 disposed on the frame 21 are spaced apart from each other and arranged in parallel. The first and second stopping rods 22, 23 have long straight sections 221, 231, concave sections 222, 232, and short straight sections 223, 233, respectively. The front and rear ends of the top of the two concave sections 222, 232 are connected to the two long straight sections 221, 231 and the two short straight sections 223, 233, respectively. The bottom of the two concave sections 222, 232 penetrates the support 11. Hence, the holding device 20 moves relative to the carrying device 10. For example, the holding device 20 in FIG. 1 is pushed in, whereas the holding device 20 in FIG. 2 is pulled out.

In particular, due to the aforesaid structures of the present invention, as shown in FIG. 2, the two concave sections 222, 232 of the first and second stopping rods 22, 23 abut against the support 11 of the carrying device 10, such that the holding device 20 is prevented from being pulled out directly. The frame 21 of the holding device 20 is stopped by the two position-limiting rods 12. Hence, the holding device 20 does not tilt downward under the weight of the front end thereof. The two concave sections 222, 232 of the first stopping rod 22 and the second stopping rod 23 are preferably manufactured by pressing.

Figure 3:
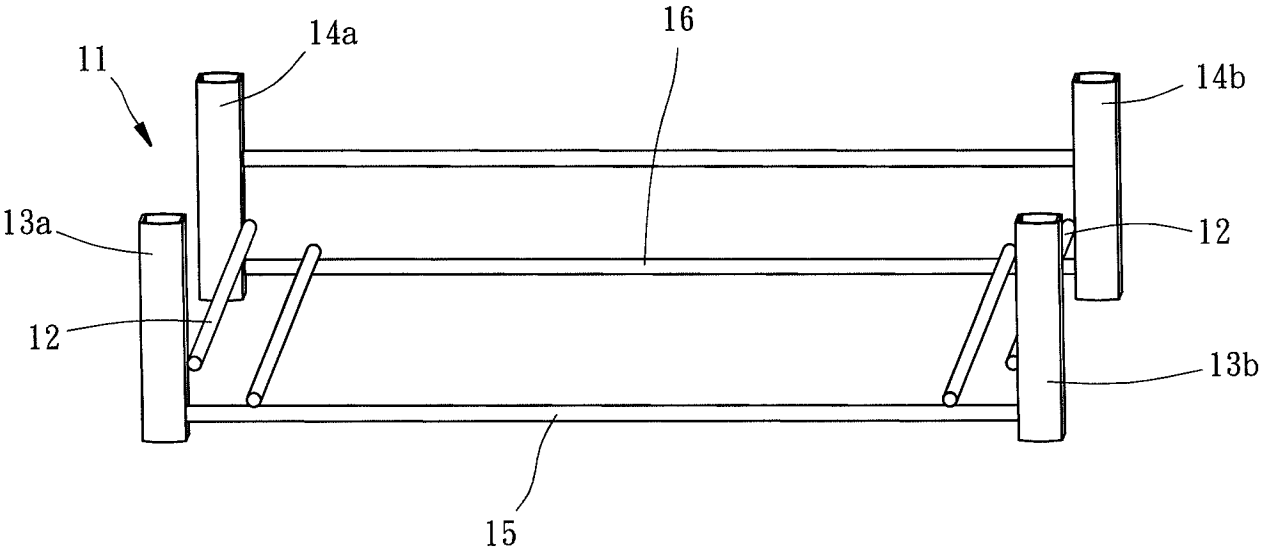
FIG. 3 is a front view of a carrying device.
Figure 4:
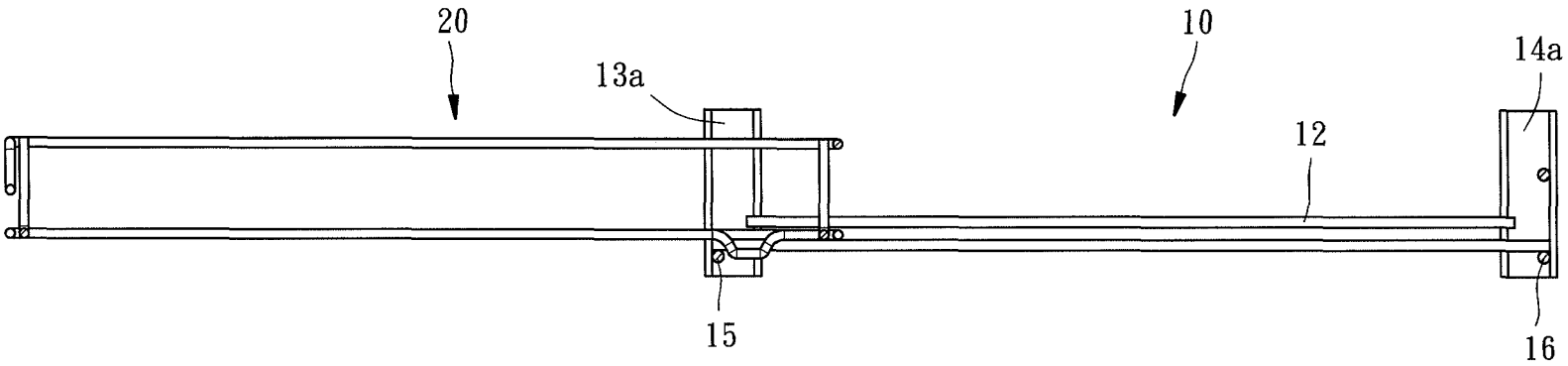
FIGS. 4, 5 are a lateral view and a cross-sectional view of the drawer structure, respectively.

Referring to FIG. 3 and FIG. 4, FIG. 3 is a schematic view of the carrying device in FIG. 2, and FIG. 4 is a cross-sectional view of the drawer structure in FIG. 2. The support 11 has two front vertical posts 13*a*, 13*b*, two rear vertical posts 14*a*, 14*b*, a front supporting rod 15, and a rear supporting rod 16. The two ends of the front supporting rod 15 are fixed to the two front vertical posts 13*a*, 13*b*, respectively, and disposed at the front end of an inner side of the two front vertical posts 13*a*, 13*b*. The two ends of the rear supporting rod 16 are fixed to the two rear vertical posts 14*a*, 14*b*, respectively, and disposed at the rear end of an inner side of the two rear vertical posts 14*a*, 14*b*, respectively. The two position-limiting rods 12 are slightly higher than the front and rear supporting rods 15, 16. The two position-limiting rods 12 are connected to the front and rear vertical posts 13*a*, 13*b*, 14*a*, 14*b*, respectively, and disposed at the front end of an inner side of the rear vertical posts 14*a*, 14*b* and at the rear end of an inner side of the front vertical posts 13*a*, 13*b*, respectively.

Figure 5:
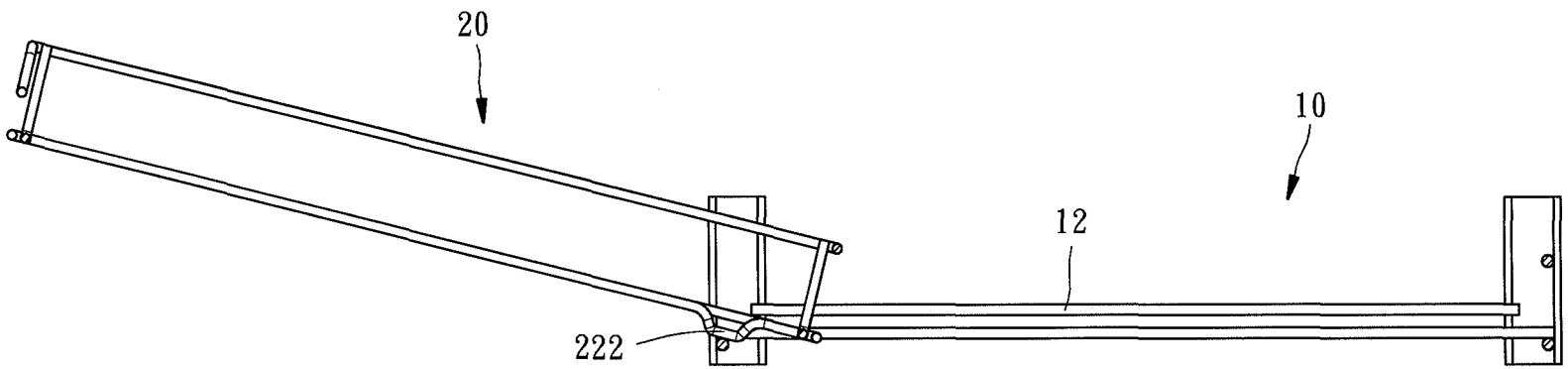

Referring to FIG. 5, to put the holding device 20 in the carrying device 10, the concave section 222 of the holding device 20 passes through the gap between the front end of the position-limiting rods 12 and the front supporting rod 15, and then the holding device 20 is obliquely put into the carrying device 10. Similarly, to remove the holding device 20 from the carrying device 10, it is necessary to pull the holding device 20 outward obliquely.

Referring to FIGS. 1, 2, the support 11 further has two guiding rods 17, 18 which are spaced apart from each other and arranged in parallel. The front and rear ends of the two guiding rods 17, 18 are fixed to the front and rear supporting rods 15, 16, respectively. First and second stopping rods of the holding device 20 are disposed between the two guiding rods 17, 18 and positioned proximate to the two guiding rods 17, 18, respectively. Hence, the support 11 supports and underpins the holding device 20. In case the holding device 20 starts to move relative to the support 11, the structural relationship between the two guiding rods 17, 18 and the two concave sections 222, 232 ensures that the holding device 20 will move relative to the support 11 back and forth smoothly.

It is also feasible for the holding device 20 to have the first stopping rod 22 only, this is, dispensing with the second stopping rod 23, and still being guided in its movement due to the mere structural relationship between the concave section 222 of the first stopping rod 22 and the guiding rod 17. Accordingly, the holding device 20 is not restricted to two stopping rods.

What is claimed is:

1. A drawer structure, comprising:

a carrying device having a support and two position-limiting rods, the two position-limiting rods being disposed on two opposing sides of the support, respectively, the support having two front vertical posts, two rear vertical posts, a front supporting rod, and a rear supporting rod, two ends of the front supporting rod being fixed to the two front vertical posts, respectively, and disposed at a front end of an inner side of the two front vertical posts, two ends of the rear supporting rod being fixed to the two rear vertical posts respectively and disposed at a rear end of an inner side of the two rear vertical posts, the two position-limiting rods being higher than the front and rear supporting rods, the two position-limiting rods each being connected to one of each of the front and rear vertical posts respectively and disposed at a rear end of the inner side of the two front vertical posts and at a front end of the inner side of the two rear vertical posts, respectively; and a holding device disposed on the carrying device, sliding relative to the carrying device, having a frame and a first stopping rod, the frame being disposed on the support and between the two position-limiting rods, the two position-limiting rods being disposed above a bottom of the frame, wherein front and rear ends of the first stopping rod are fixed to front and rear sides of the frame, respectively, and disposed at the bottom of the frame, the first stopping rod having a long straight section, a concave section, and a short straight section, wherein front and rear ends of a top of the concave section are connected to the long straight section and the short straight section, respectively, wherein a bottom of the concave section penetrates the support.

2. The drawer structure of claim 1, wherein the support further has two guiding rods spaced apart from each other and arranged in parallel, wherein front and rear ends of the two guiding rods are fixed to the front and rear supporting rods, respectively, wherein the first stopping rod of the holding device is disposed between the two guiding rods and positioned proximate to one of the two guiding rods.

3. The drawer structure of claim 1, wherein the holding device further has a second stopping rod having front and rear ends fixed to the front and rear sides of the frame, respectively, disposed at the bottom of the frame, and having a long straight section, a concave section, and a short straight section, wherein front and rear ends of the concave section are connected to the long straight section and the short straight section, respectively, wherein a bottom end of the concave section penetrates the support, wherein the first and second stopping rods of the frame are spaced apart from each other and arranged in parallel.

4. The drawer structure of claim 3, wherein the support further has two guiding rods spaced apart from each other, arranged in parallel, and having front and rear ends fixed to the front and rear supporting rods, respectively, wherein the first stopping rod and the second stopping rod of the holding device are disposed between the two guiding rods and positioned proximate to the two guiding rods, respectively.

* * * * *